US005826599A

United States Patent [19]

Adams

[11] Patent Number: 5,826,599

[45] Date of Patent: Oct. 27, 1998

[54] DENTAL FINGER TOOTHBRUSH

[76] Inventor: Bill R. Adams, P.O. Box 601, 30B-3C, Pendleton, Ind. 46064

[21] Appl. No.: 831,888

[22] Filed: Apr. 3, 1997

[51] Int. Cl.[6] ..... A45D 44/18

[52] U.S. Cl. ..... 132/308; 15/167.1; 15/227

[58] Field of Search ..... 132/308; 15/167.1, 15/227; 401/7

[56] References Cited

U.S. PATENT DOCUMENTS

| | | | |
|---|---|---|---|
| 1,894,413 | 1/1933 | Nenning et al. | 15/167.1 |
| 2,075,681 | 3/1937 | Welker | 401/7 |
| 2,077,540 | 4/1937 | Welker | 401/7 |
| 2,921,590 | 1/1960 | Holton | 15/167.1 |
| 3,018,498 | 1/1962 | Wasserman | 15/167.1 |
| 4,134,172 | 1/1979 | Arce | 15/167.1 |
| 4,628,949 | 12/1986 | Mas et al. | 132/308 |
| 4,893,373 | 1/1990 | Kato | 15/227 |
| 5,107,562 | 4/1992 | Dunn | 15/167.1 |
| 5,181,531 | 1/1993 | Escoto et al. | 132/308 |
| 5,348,153 | 9/1994 | Cole | 206/361 |
| 5,349,715 | 9/1994 | Lewis, Jr. | 15/227 |
| 5,440,774 | 8/1995 | Cole | 15/105 |
| 5,555,590 | 9/1996 | Blum et al. | 15/167.1 |

FOREIGN PATENT DOCUMENTS

| | | | |
|---|---|---|---|
| 1722439 | 3/1992 | Russian Federation | 15/167.1 |

*Primary Examiner*—John J. Wilson

*Attorney, Agent, or Firm*—Woodard, Emhardt, Naughton, Moriarty & McNett

[57] ABSTRACT

A dental finger toothbrush includes a finger device with a first end and a second end. The dental finger toothbrush further includes a cleaning head and an inside platform. The cleaning head is coupled to the inside platform with the first end of the finger device disposed between the coupling. The finger device is adapted to be received on a finger through the second end, or rolled onto a finger from the first end to the second end. The dental finger toothbrush can further include a locking strap adapted to attach to the cleaning head and adapted to wrap around a finger. The locking strap can further be adapted to wrap around the cleaning head. A dental hygiene packet includes a packaged dental finger toothbrush and packaged toothpaste.

20 Claims, 15 Drawing Sheets

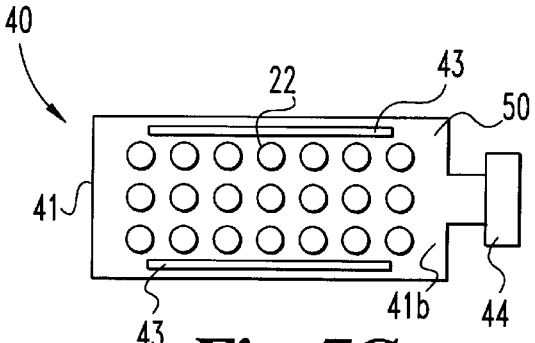
Fig. 7A
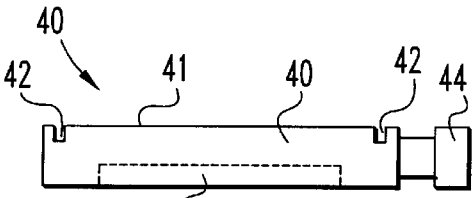
Fig. 7B
Fig. 7C
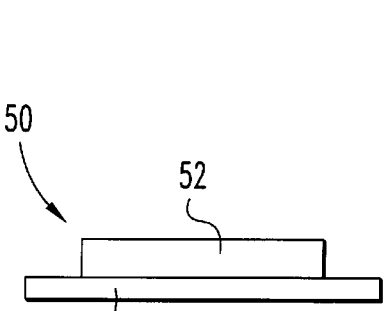
Fig. 8A
Fig. 8B
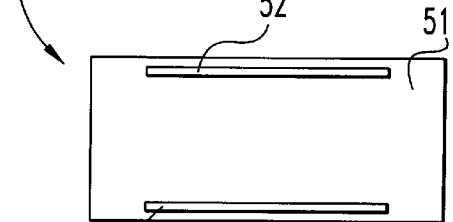
Fig. 8C

DENTAL FINGER TOOTHBRUSH

BACKGROUND OF THE INVENTION

The present invention generally relates to toothbrushes and dental hygiene packets, and more specifically, to a new and useful dental finger toothbrush and a dental hygiene packet including the new and useful dental finger toothbrush.

The convenience and availability of a clean and healthy mouth is important to most, if not all, people. Consequently, dental hygiene packets have been developed to meet the dental hygiene needs of people under circumstances where a toothbrush and a tube of toothpaste are either burdensome to transport, or inconvenient to retrieve, or generally unavailable after a meal. Such circumstances include, but are not limited to: (1) military soldiers engaging in combat or field exercises; (2) camping, fishing and hunting trips; (3) travelers waiting at a bus depot, waiting at an airport, flying in an airplane, conducting a space mission, or driving for lengthy periods of time; (4) people who are bed ridden at home, in a hospital or in a nursing home, especially those individuals who must have their teeth brushed for them; (5) people patronizing a restaurant, a dance club or other night spots; (6) students at all educational levels, especially ones who eat their lunch in a school cafeteria; (7) people staying overnight at the homes of relatives or friends; (8) guests at hotels, motels and inns; and (9) people in jail or prison, especially individuals who have been labeled a security risk or who are in solitary confinement.

A dental finger toothbrush is one component that may be found in a dental hygiene packet. In past attempts to develop a dental hygiene packet, a dental finger toothbrush typically comprised a finger device, such as a latex condom, and a cleaning head having some form of cleaning element like bristles. The cleaning head is either integrally formed with the finger device, adhesively bonded to the finger device, or heat bonded to the finger device. However, there are two major problems associated with these current designs of dental finger toothbrushes that are separately addressed by the present invention. First, there are many manufacturing problems with the aforementioned approaches of attaching the cleaning head to the finger device. For instance, heat bonding the cleaning head to the finger device tends to melt the surfaces of the cleaning head, and finger device. In addition, the cleaning head does not provide rotational and linear stability to dental finger toothbrush during brushing. Second, manufacturing a dental finger toothbrush so as to fit the masses can be an extensive and difficult process. Similarly, manufacturing varying sizes of dental finger toothbrushes can be inefficient from a cost standpoint.

What is therefore needed is a dental finger toothbrush having a more effective way to attach a cleaning head to a finger device that provides rotational and linear stability to the dental finger toothbrush. What is further needed is a dental finger toothbrush that can be efficiently and easily manufactured to fit all sizes.

SUMMARY OF THE INVENTION

The present invention relates to a dental finger toothbrush and a dental hygiene packet including the dental finger toothbrush. Various aspects of the present invention are novel, non-obvious, and provide various advantages. While the actual nature of the present invention described in detail herein can only be determined with reference to the claims appended hereto, certain features which are characteristic of the present invention disclosed herein can be described briefly.

In accordance with one embodiment of the present invention, a dental finger toothbrush comprises a finger device having a first end and a second end, a cleaning head and an inside platform. The cleaning head is coupled to the inside platform with the first end of the finger device disposed therebetween.

In accordance with a second embodiment of the present invention, a dental finger toothbrush comprises a finger device having a first end and a second end, a cleaning head, an inside platform coupled to the cleaning head with the first end of the finger device disposed therebetween, and a locking strap adapted to be attached to the cleaning head. The locking strap is further adapted to wrap around the finger device so as to secure the dental finger toothbrush to a finger.

In accordance with a third embodiment of the present invention, a dental hygiene packet comprises a package of toothpaste and either a dental finger toothbrush in accordance with the first embodiment of the present invention, or a dental finger toothbrush in accordance with the second embodiment of the present invention.

It is an object of the present invention to provide an easily manufacturable dental finger toothbrush.

It is another object of the present invention to provide a dental finger toothbrush having rotational and linear stability on a finger during brushing.

It is another object of the present invention to provide a dental finger toothbrush that fits all sizes of fingers.

These and other objects as well as advantages of the present invention will become more apparent from the following description of the preferred embodiments.

BRIEF DESCRIPTION OF THE DRAWINGS

FIG. 7A is a top view of a cleaning head in accordance with the second embodiment of the present invention.

FIG. 7B is a side view of the cleaning head of FIG. 7A.

FIG. 7C is a bottom view of the cleaning head of FIG. 7A.

FIG. 8A is a top view of an inside platform in accordance with the second embodiment of the present invention.

FIG. 8B is a side view of the inside platform of FIG. 8A.

FIG. 8C is a bottom view of the inside platform of FIG. 8A.

DESCRIPTION OF THE PREFERRED EMBODIMENTS

Figure 1A:
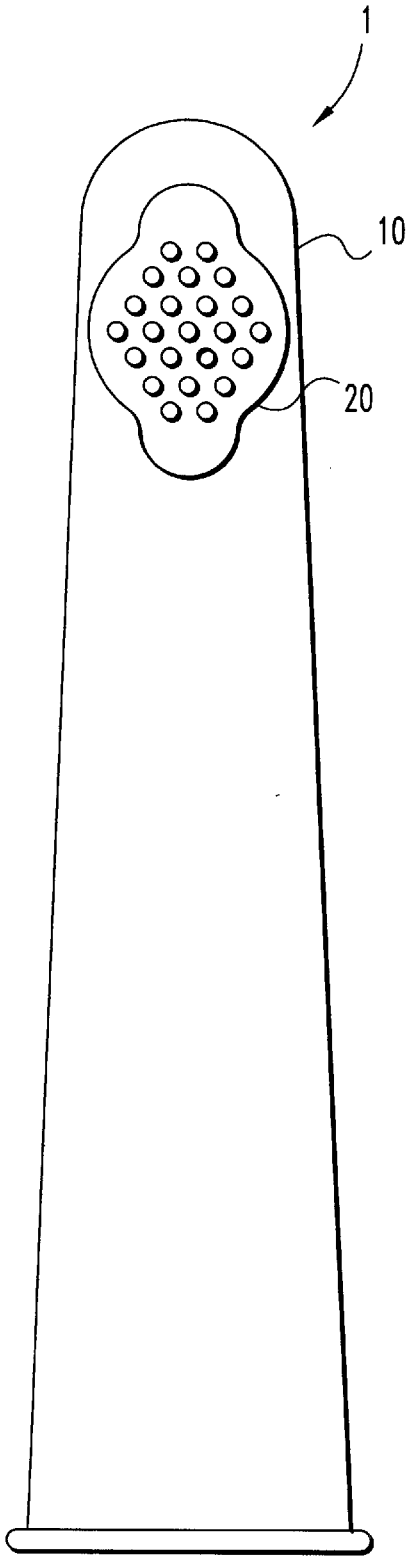
FIG. 1A is a bottom view of a dental finger toothbrush in accordance with the first embodiment of the present invention.

For the purposes of promoting an understanding of the principles of the present invention, reference will now be made to the embodiments illustrated in the drawings and specific language will be used to describe the same. It will nevertheless less be understood that no limitation of the scope of the present invention is thereby intended, such alterations and further modifications in the illustrated articles of manufacture, and such further applications of the principles of the present invention as illustrated therein being contemplated as would normally occur to one skilled in the art to which the present invention relates.

Figure 1B:
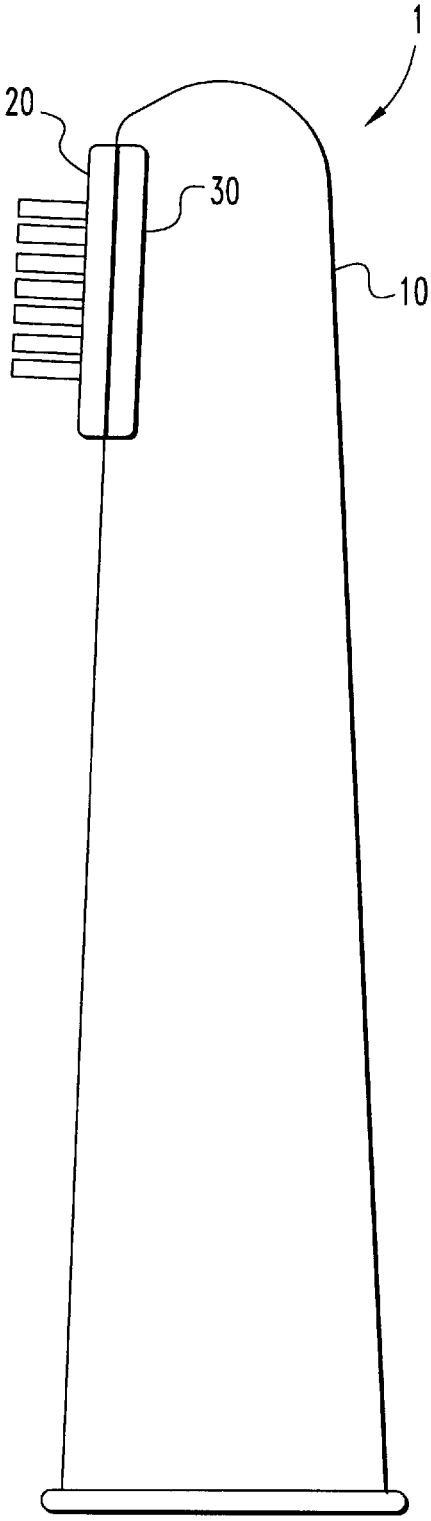
FIG. 1B is a cross-sectional side view of the dental finger toothbrush of FIG. 1A.

FIGS. 1A and 1B are a bottom view and a cross-sectional side view, respectively, of a dental finger toothbrush 1 in accordance with the first embodiment of the present invention. Dental finger toothbrush 1 comprises a finger device 10, a cleaning head 20, and an inside platform 30. The cleaning head 20 is coupled to inside platform 30, and the finger device 10 is disposed therebetween. As described in detail herein, it is to be appreciated and understood that finger device 10 is adapted to be mounted on a finger, cleaning head 20 is adapted to brush teeth, and inside platform 30 is adapted to be fixed against the finger during brushing.

Figure 2A:
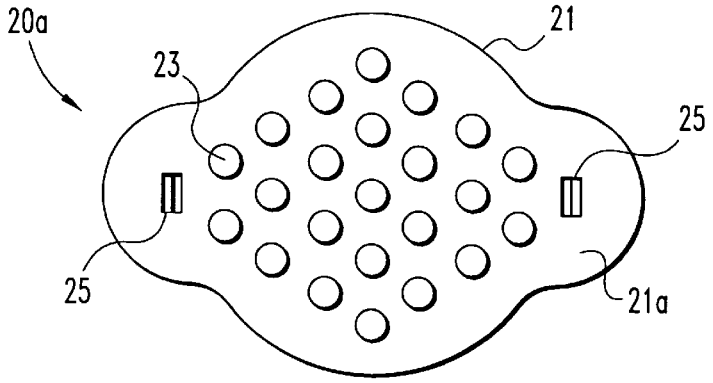
FIG. 2A is a top view of a first cleaning head in accordance with the first embodiment of the present invention.
Figure 2B:
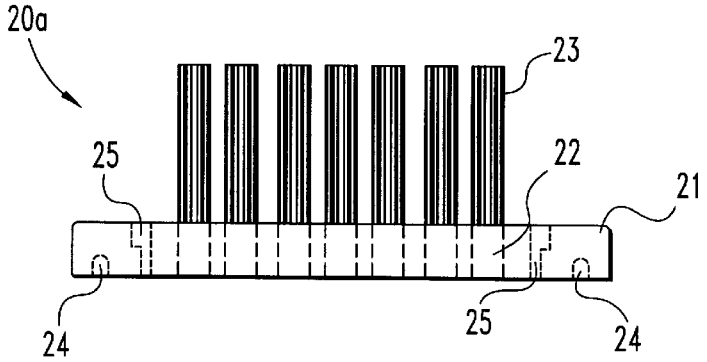
FIG. 2B is a side view of the first cleaning head of FIG. 2A.
Figure 2C:
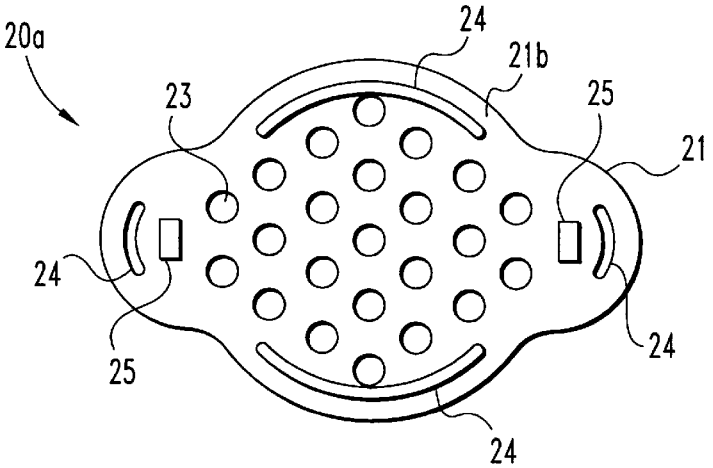
FIG. 2C is a bottom view of the first cleaning head of FIG. 2A.

FIGS. 2A, 2B and 2C are a top view, a side view, and a bottom view, respectively, of a first cleaning head 20*a*. Cleaning head 20*a* includes a body 21 having a top side 21*a* and a bottom side 21*b*, a plurality of bristle holes 22 throughout body 21 extending from top side 21*a* to bottom side 21*b*, bristles 23 securely inserted in bristle holes 22, four grooves 24 disposed in bottom side 21*b*, and two slots 25 throughout body 21 extending from top side 21*a* to bottom side 21*b*. While bristles 23 as illustrated are the preferred cleaning element of cleaning head 20*a*, the present invention contemplates the use of any type of cleaning element that can be affixed to top side 21*a* of cleaning head 20*a*. Examples of alternative cleaning elements include a sponge spot, and a rubber cup. In addition, while four is the preferred number of grooves 24 and two is the preferred number of slots 25, the present invention contemplates that more or less number of grooves 24 and/or slots 25 can be utilized.

Figure 2D:
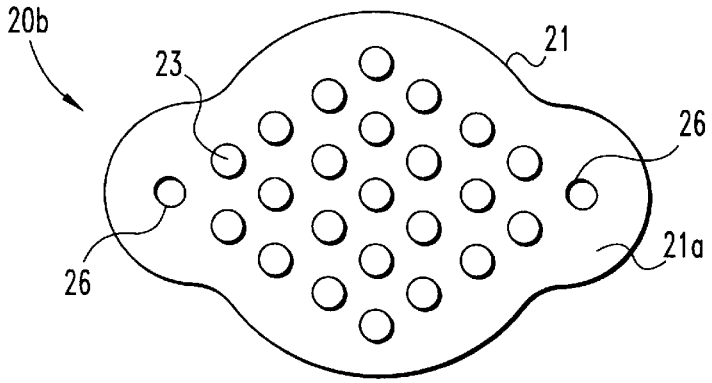
FIG. 2D is a top view of a second cleaning head in accordance with the first embodiment of the present invention.
Figure 2E:
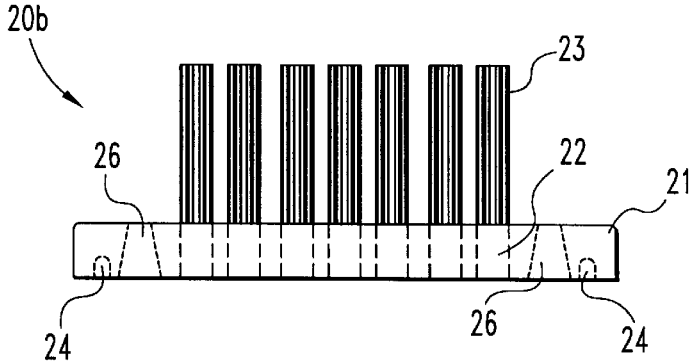
FIG. 2E is a side view of the second cleaning head of FIG. 2D.
Figure 2F:
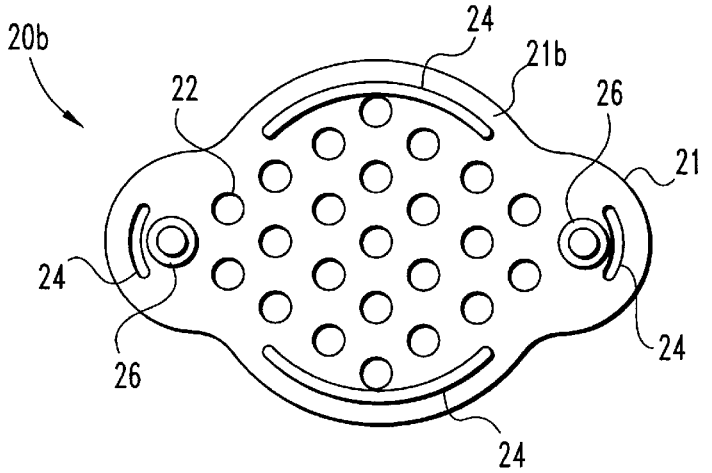
FIG. 2F is a bottom view of the second cleaning head of FIG. 2D.

FIGS. 2D, 2E and 2F are a top view, a side view, and a bottom view, respectively, of a second cleaning head 20*b*. Cleaning head 20*b* includes the same elements as cleaning head 20*a* with the exception of two peg-shaped slots 26 in lieu of slots 25. Again, the present invention contemplates that an alternative cleaning element like a sponge spot or a rubber cup can be utilized, and that more or less number of grooves 24 and/or slots 26 can be utilized.

Figure 2G:
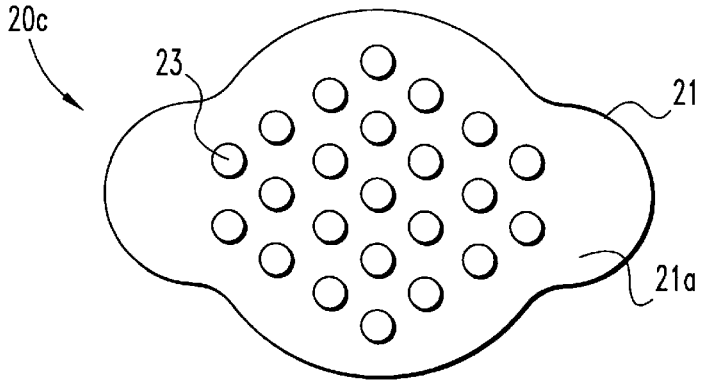
FIG. 2G is a top view of a third cleaning head in accordance with the first embodiment of the present invention.
Figure 2H:
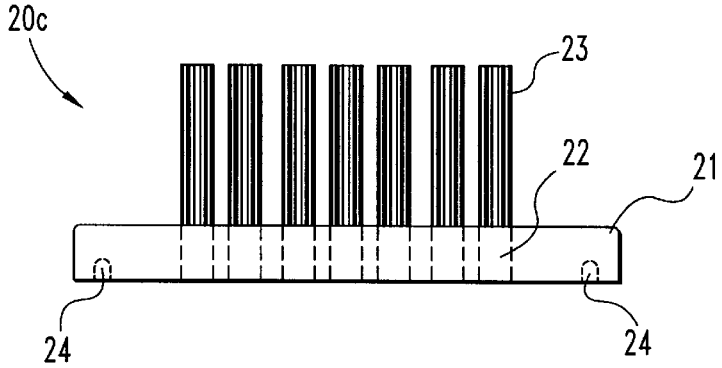
FIG. 2H is a side view of the third cleaning head of FIG. 2G.
Figure 2I:
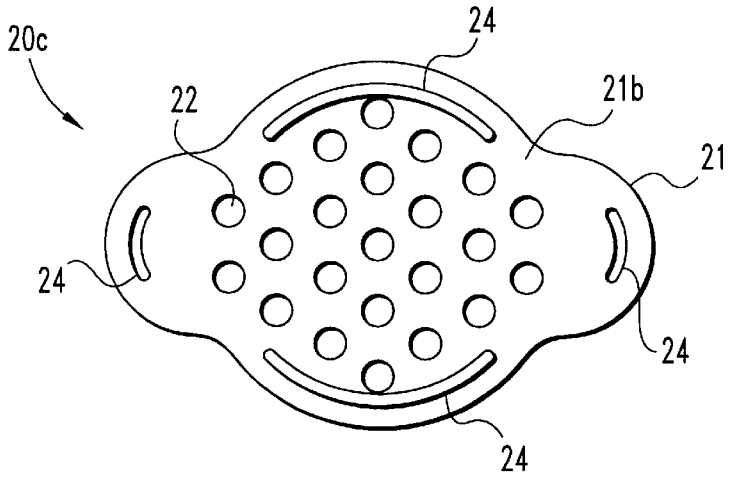
FIG. 2I is a bottom view of the third cleaning head of FIG. 2G.

FIGS. 2G, 2H and 2I are a top view, a side view, and a bottom view, respectively, of a third cleaning head 20*c*. Cleaning head 20*c* includes the same elements as cleaning heads 20*a* and 20*b* except for slots 25 and slots 26. Again, the present invention contemplates that an alternative cleaning element like a sponge spot or a rubber cup can be utilized, and that more or less number of grooves 24 can be utilized.

Figure 3A:
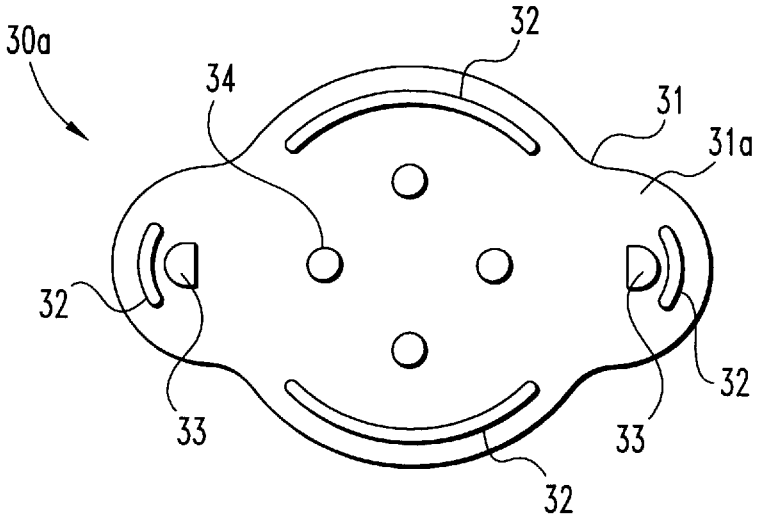
FIG. 3A is a top view of a first inside platform in accordance with the first embodiment of the present invention.
Figure 3B:
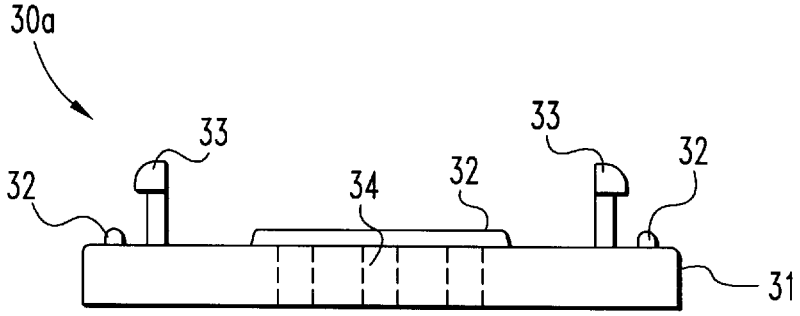
FIG. 3B is a side view of the first inside platform of FIG. 3A.

FIGS. 3A and 3B are a top view and a side view, respectively, of a first inside platform 30*a*. Inside platform 30*a* includes a body 31 having a top side 31*a*, four prongs 32 adapted to mate with grooves 24, and two prongs 33 adapted to snap within slots 25 of cleaning head 20*a*. The present invention contemplates that there will be a one-to-one correlation in the number of prongs 32 to grooves 24, and prongs 33 to slots 25. Inside platform 30*a* can further include gripping holes 34 extending throughout body 31. Gripping holes 34 are intended to grip a finger so as to further hold inside platform 30*a* securely to a finger. While gripping holes 34 are the preferred elements for the further securing of inside platform 30*a* to a finger, the present invention contemplates that other securing means may be used.

Figure 3C:
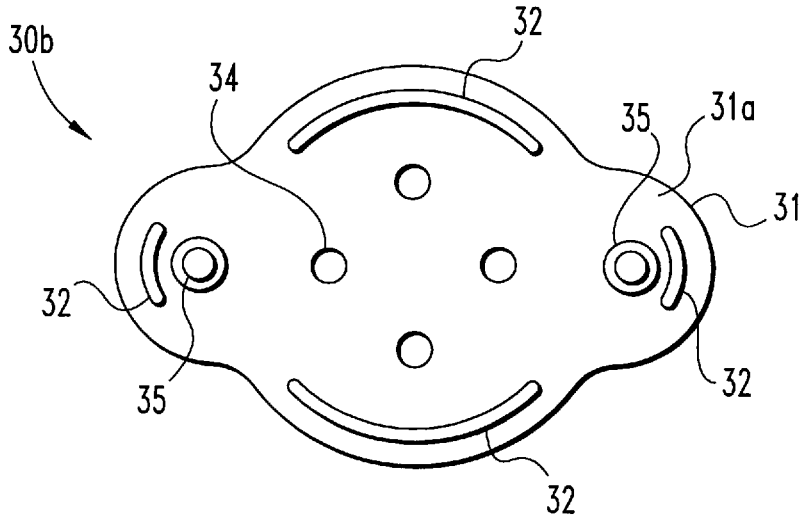
FIG. 3C is a top view of a second inside platform in accordance with the first embodiment of the present invention.
Figure 3D:
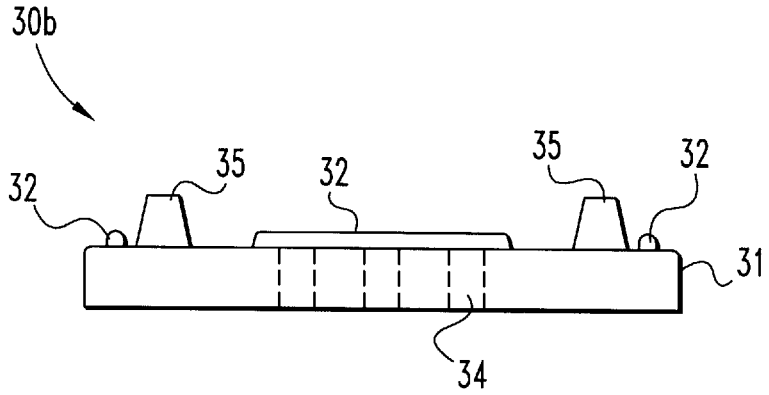
FIG. 3D is a side view of the second inside platform of FIG. 3C.

FIGS. 3C and 3D are a top view and a side view, respectively, of a second inside platform 30*b*. Inside platform 30*b* includes body 31, four prongs 32 adapted to mate with grooves 24, and two prongs 35 adapted to tension fit within slots 26 of cleaning head 20*b*. The present invention contemplates that there will be a one-to-one correlation in the number of prongs 32 to grooves 24, and prongs 35 to slots 26. Inside platform 30*b* can also further include gripping holes 34 extending throughout body 31.

Figure 3E:
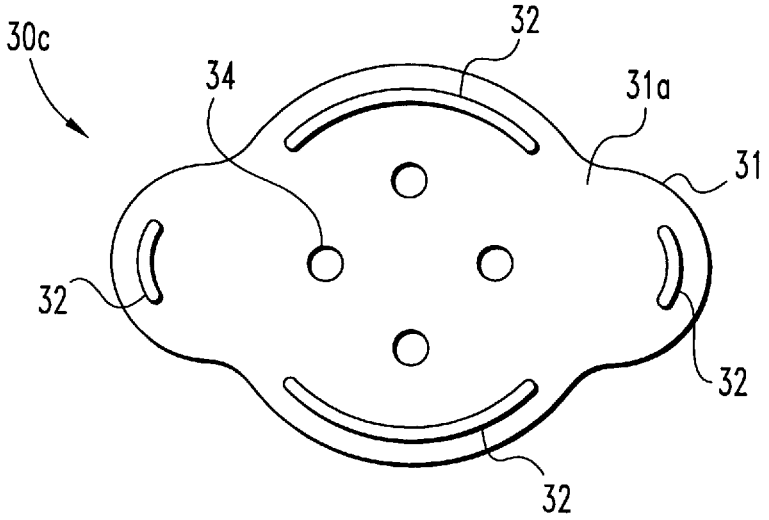
FIG. 3E is an top view of a third inside platform in accordance with the first embodiment of the present invention.
Figure 3F:
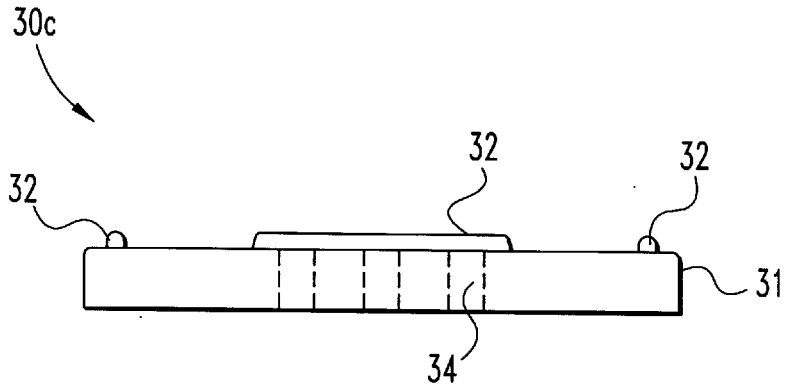
FIG. 3F is a view of the third inside platform of FIG. 3E.

FIGS. 3E and 3F are a top view and a side view, respectively, of a third inside platform 30*c*. Inside platform 30*c* includes body 31, and four prongs 32 adapted to mate with grooves 24. The present invention contemplates that there will be a one-to-one correlation in the number of prongs 32 to grooves 24. Inside platform 30*c* can also further include gripping holes 34 extending throughout body 31.

Figure 4:
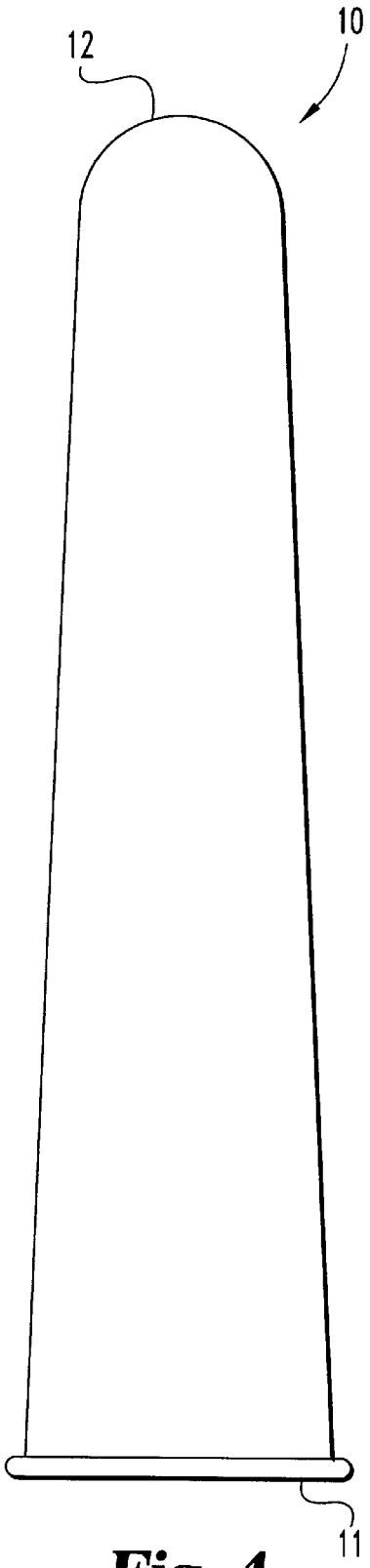
FIG. 4 is a view of a finger device in accordance with the present invention.

FIG. 4 is a view of a finger device 10 in accordance with the present invention. Finger device 10 includes an first end 11 and a second end 12. Preferably, first end 11 is an open end of finger device 10 adapted to receive a finger within finger device 10 and second end 12 is a closed end of finger device 10 adapted to substantially form fit around the tip of a finger received within finger device 10. However, the present invention contemplates that second end 12 can also be an opened end of finger device 10. The present invention further contemplates that second end 12 can be a closed end of finger device 10 having a slit (not shown) adapted to receive a fingernail.

The present invention contemplates that finger device 10 is any device that can be received on or rolled onto a finger. The configuration of finger device 10 prior to be received on or rolled onto a finger can vary. However, it is preferred that finger device 10 have a configuration when received on or rolled onto a finger that is substantially similar to the configuration shown in FIG. 4. The advantage of a finger device 10 that can be received on or rolled onto a finger is the ability to package dental finger toothbrush 1 similar to the packaging of a condom. This allows for an easy insertion of dental finger toothbrush 1 into a dental hygiene packet as shown in FIG. 13B. Preferably, finger device 10 is substantially made from hygienically protective material such as latex rubber, polyethylene, cellophane and vinyl. In addition, it is preferred that finger device 10 be made from material having biodegradable properties. The advantage of a biodegradable finger device 10 is the ability to use dental finger toothbrush 1 as a disposal toothbrush without causing significant harm to the environment.

Figure 5A:
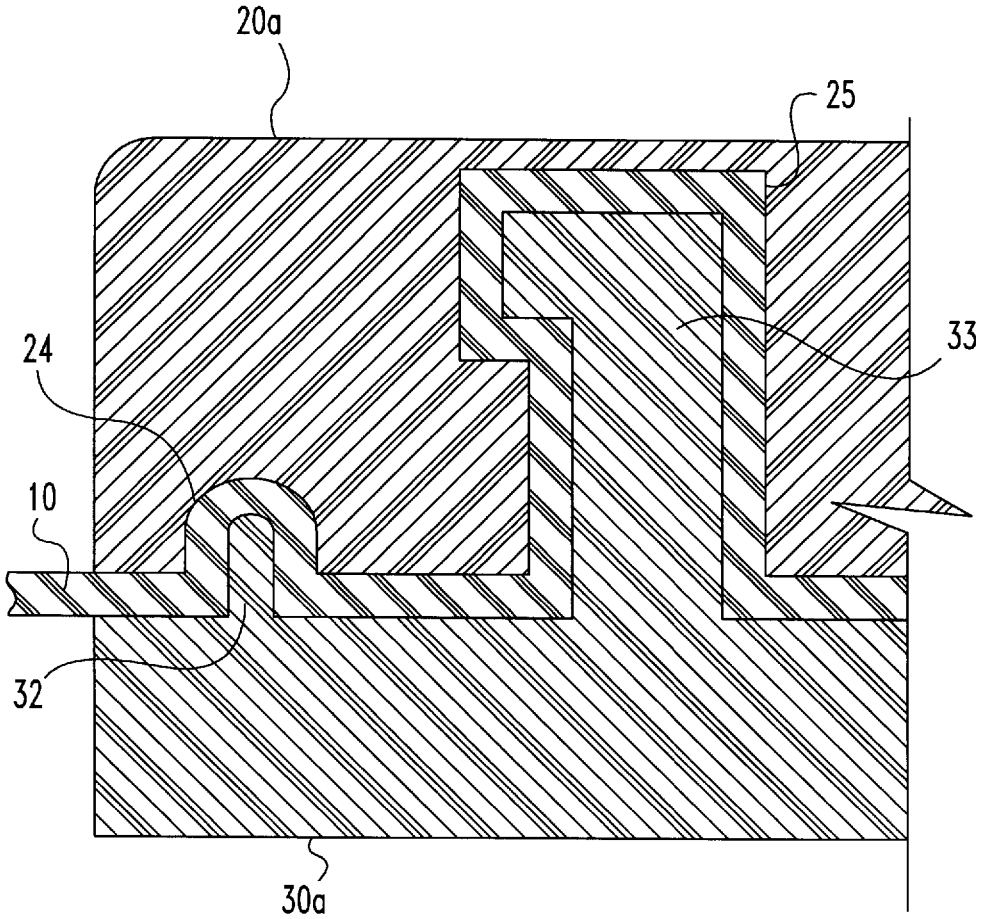
FIG. 5A is a cross-sectional side view of the first inside platform of FIGS. 3A–3B coupled to the first cleaning head of FIGS. 2A–2C with a closed end of the finger device of FIG. 4 disposed therebetween.

Referring back to FIGS. 2B and 3B, grooves 24 of cleaning head 20*a* and prongs 32 of inside platform 30*a* are adapted to mate when the finger device 10 is disposed between grooves 24 and prongs 32, while slots 25 of cleaning head 20*a* are adapted to couple with prongs 33 of inside platform 30*a*. FIG. 5A is cross-sectional illustration of a mating between groove 24 and prong 32, and a coupling between slot 25 and prong 33. As shown in FIG. 5A, with finger device 10 disposed between cleaning head 20*a* and inside platform 30*a*, groove 24 mates with prong 32 and prong 33 snaps within slot 25. It is to be understood and appreciated that prong 33 is intended to snap with slot 25, thus coupling cleaning head 20*a* and inside platform 30*a*. This provides rotational and linear stability to dental finger toothbrush 1. It is also to be understood and appreciated that the mating of groove 24 and prong 32 is intended to further promote rotational and linear stability to dental finger toothbrush 1.

Figure 5B:
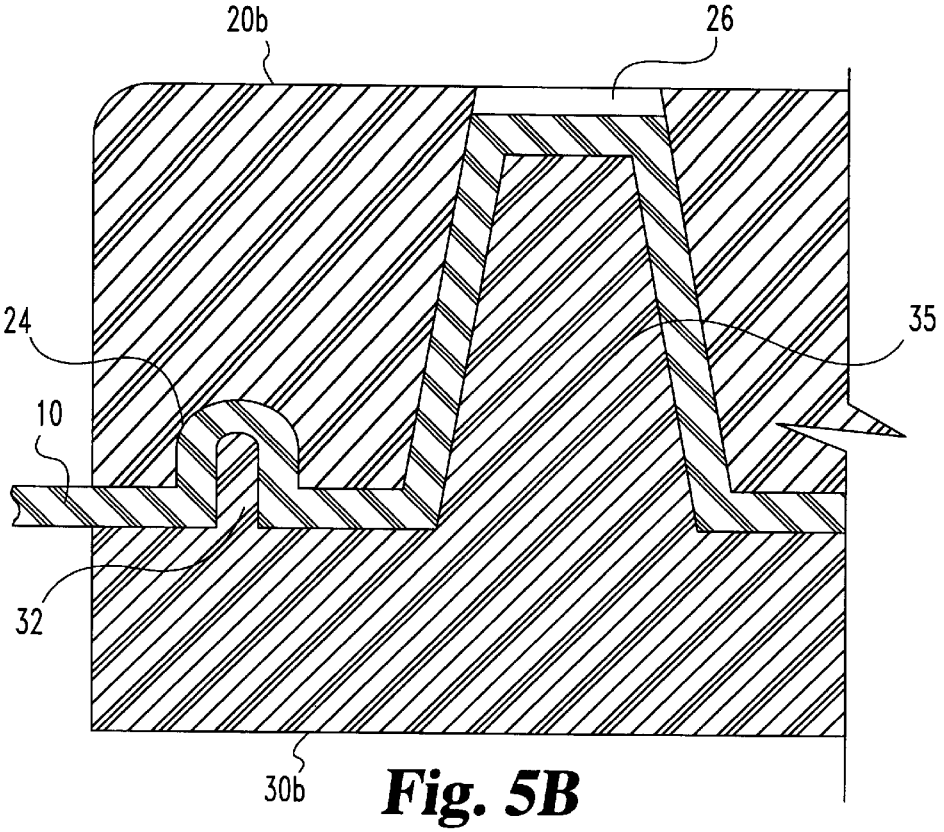
FIG. 5B is a cross-sectional side view of the second inside platform of FIGS. 3C–3D coupled to the second cleaning head of FIGS. 2D–2F with the closed end the finger device of FIG. 4 disposed therebetween.

Referring back to FIGS. 2E and 3D, grooves 24 of cleaning head 20*b* and prongs 32 of inside platform 30*b* are adapted to mate when the finger device 10 is disposed between grooves 24 and prongs 32, while prongs 35 of inside platform 30*b* are adapted to couple with slots 26 of cleaning head 20*b*. FIG. 5B is a cross-sectional illustration of a mating between groove 24 and prong 32, and a coupling between slot 26 and prong 35. The present invention contemplates that prongs 35 has a diameter that is larger than the diameter of slots 26, thus causing prongs 35 to tension fit within slots 26 after being forced within slots 26. As shown in FIG. 5B, the present invention anticipates that tension fitting prong 35 with slot 26 may cause prong 35 to slightly retract within slot 26. It is to be understood and appreciated that prong 35 is intended to tension fit within slot 26, thus coupling cleaning head 20*b* and inside platform 30*b*. This provides rotational and linear stability to dental finger toothbrush 1. It is also to be understood and appreciated that the mating of groove 24 and prong 32 is intended to further promote rotational and linear stability to dental finger toothbrush 1.

Figure 5C:
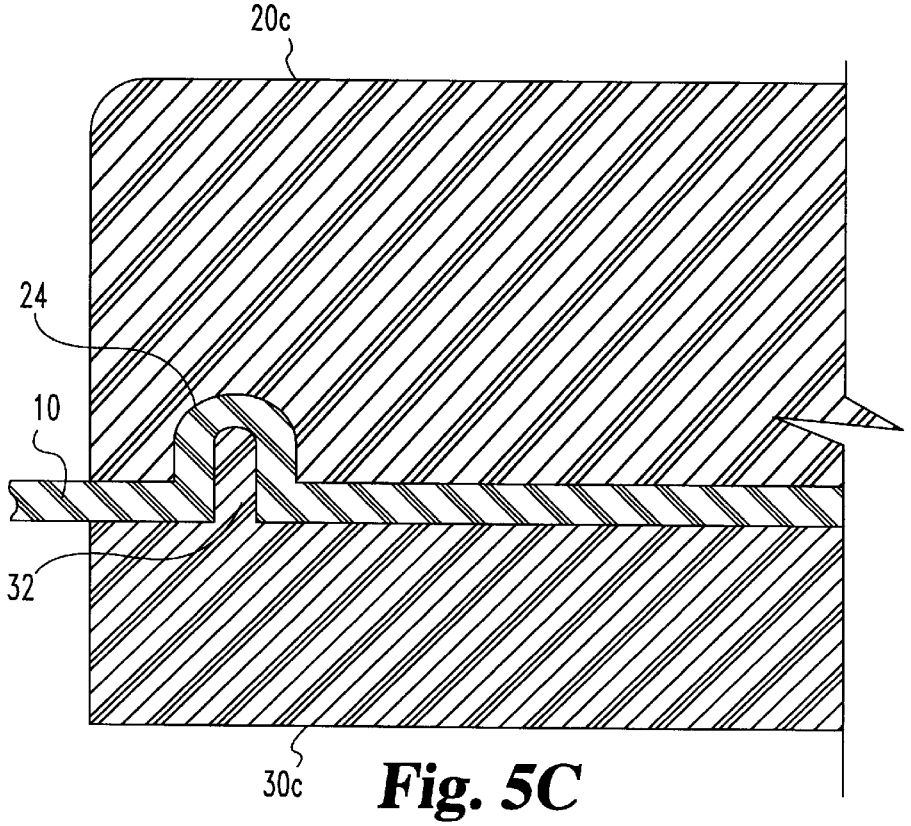
FIG. 5C is a cross-sectional side view of the third inside platform of FIGS. 3E–3F coupled to the third cleaning head of FIGS. 2G–2I with the closed end of the finger device of FIG. 4 disposed therebetween.

Referring back to FIGS. 2H and 3F, grooves 24 of cleaning head 20*c* and prongs 32 of inside platform 30*c* are adapted to mate when the finger device 10 is disposed between grooves 24 and prongs 32. FIG. 5C is a cross-sectional side view of such a mating between groove 24 and prong 32. As shown in FIG. 5C, with finger device 10 disposed between cleaning head 20*c* and inside platform 30*c*, groove 24 mates with prong 32. It is to be understood and appreciated that cleaning head 20*c* and inside platform 30*c* are both bonded to finger device 10, thus coupling cleaning head 20*c* with inside platform 30*c*. The present invention contemplates that cleaning head 20*c* and inside platform 30*c* can be bonded by any means to finger device 10, including improved methods of heat bonding and adhesive bonding. Preferably, the chosen bonding means does not damage finger device 10, cleaning head 20*c*, and/or inside platform 30*c*. It is also to be understood and appreciated that the mating of groove 24 and prong 32 is intended to promote rotational and linear stability to dental finger toothbrush 1.

It is to be further appreciated and understood that inside platform 30 is an essential component of the first embodiment of the present invention. One benefit of inside platform 30 is the ability to easily and effectively fasten cleaning head 20 to a delicate finger device 10. Another benefit of inside platform 30 is the ability to exert enormous force on cleaning head 20 when brushing while maintaining rotational and linear stability of finger device 10 on a finger.

Referring back to FIG. 4, the preferred manufacturing process for dental finger toothbrush 1 will now be described. The first step is to align and couple cleaning head 20 and inside platform 30 with a first layer of finger device 10 disposed therebetween. The second step is to place a second layer of finger device 10 over inside platform 30. The final step is seal and cut the first layer and second layer of finger device 10 in order to form dental finger toothbrush 1. It is to be appreciated and understood that the preferred manufacturing process is simple to implement and cost effective.

Figure 6A:
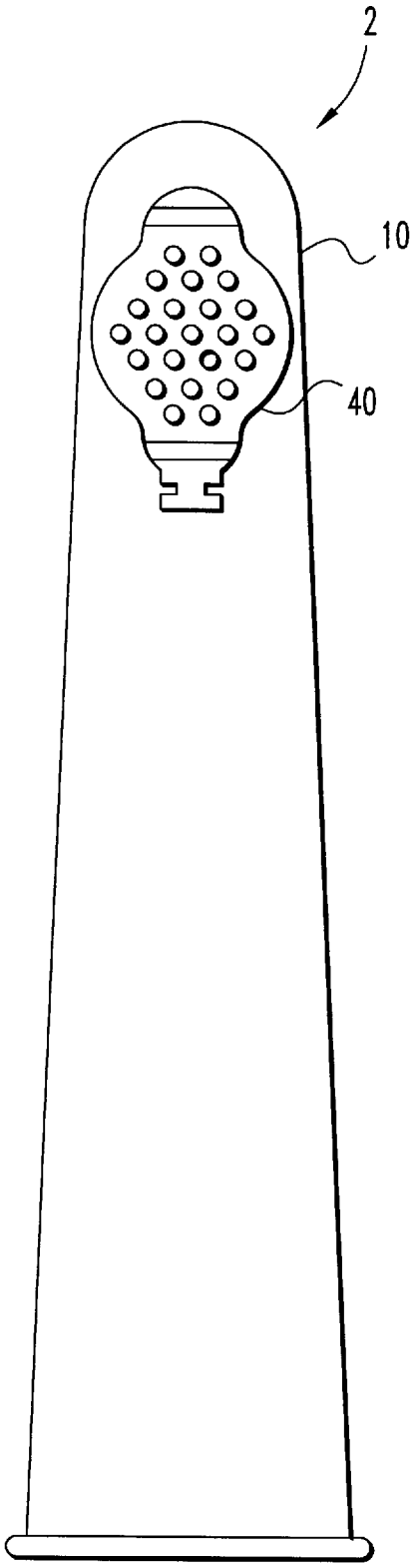
FIG. 6A is a bottom view of a dental finger toothbrush in accordance with the second embodiment of the present invention.
Figure 6B:
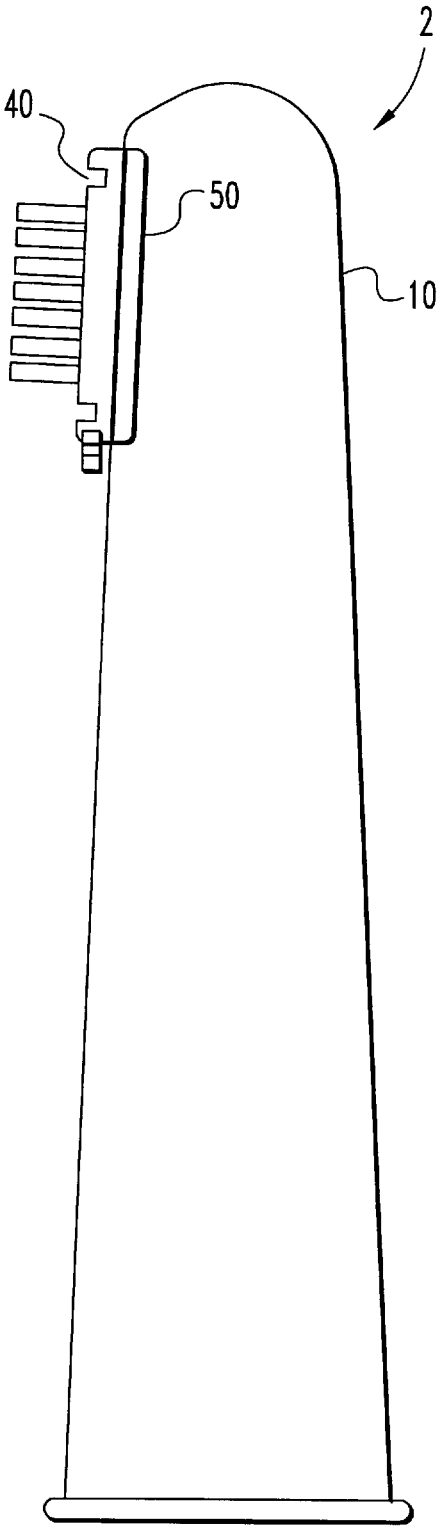
FIG. 6B is a cross-sectional side view of the dental finger toothbrush of FIG. 6A.

FIGS. 6A and 6B are a bottom view and a cross-sectional side view, respectively, of a dental finger toothbrush 2 in accordance with a second embodiment of the present invention. Dental finger toothbrush 2 comprises a finger device 10, a cleaning head 40, an inside platform 50, and a locking strap 60 (not shown). Cleaning head 40 is coupled to inside platform 50, and finger device 10 is disposed therebetween. As shown, the present invention contemplates that dental finger toothbrush 2 includes inside platform 50 so as to obtain the benefits of having inside platform 50. However, the second embodiment of the present invention is directed to the need of a dental finger toothbrush that can be efficiently and easily manufacture to fit all sizes. Consequently, the present invention contemplates that cleaning head 40 can be attached by any means to finger device 10, and inside platform 50 can be discarded.

FIGS. 7A, 7B and 7C are a top view, a side view, and a bottom view, respectively, of cleaning head 40. Cleaning head 40 includes a body 41 having a top side 41*a* and a bottom side 41*b*, a plurality of bristle holes 22 (not shown in FIG. 7B) throughout body 41 extending from top side 41*a* to bottom side 41*b*, bristles 23 (not shown) inserted in bristle holes 22, two grooves 43 disposed in bottom side 41*b*, and a locking hook 44. Cleaning head 40 may further include two grooves 42 disposed in top side 41*a*.

FIGS. 8A, 8B, and 8C are a bottom view, a side view and a top view, respectively, of inside platform 50. Inside platform 50 includes a body 51 and two prongs 52 adapted to mate with grooves 43. The present invention contemplates that there will be a one-to-one correlation in the number of prongs 52 to grooves 43. The present invention further contemplates that grooves 43 and prongs 52 can be coupled similar to slot 25 and prong 33 as described herein and shown in FIG. 5A, similar to slot 26 and prong 35 as described herein and shown in FIG. 5B, and similar to groove 24 and prong 32 as described herein and shown in FIG. 5C. Inside platform 50 can further include gripping holes 34 (not shown) extending throughout body 51, or any other means for securing inside platform 50 to a finger.

Figure 9A:
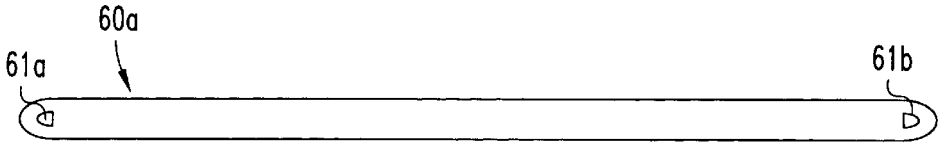
FIG. 9A is a view of a first locking strap in accordance with the second embodiment of the present invention.
Figure 10A:
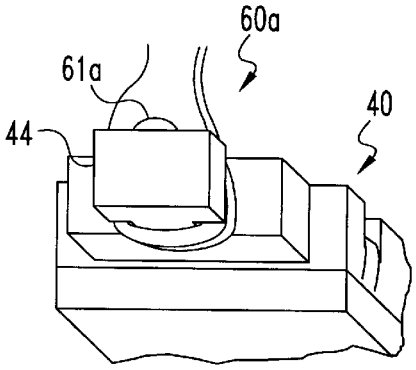
FIG. 10A is a view the first locking strap of FIG. 9A partially connected to the cleaning head of FIGS. 7A–7C.
Figure 10B:
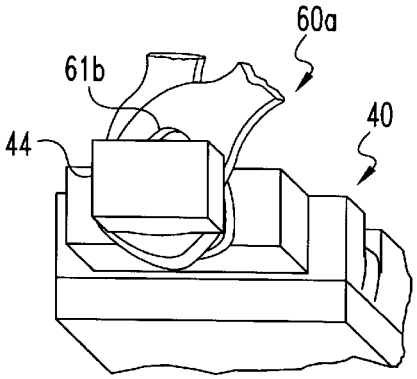
FIG. 10B is a view of the first locking strap of FIG. 9A completely connected to the cleaning head of FIG. 7A–7C.

FIG. 9A is an illustration of locking strap 60*a*. Locking strap 60*a* includes a first hole 61*a* and a second hole 61*b*. Holes 61*a* and 61*b* are adapted to be affixed around locking hook 44. FIG. 10A is illustrative of hole 61*a* affixed around locking hook 44 prior to wrapping locking strap 60*a* around finger device 10 and cleaning head 40, while FIG. 10B is illustrative of hole 61*b* affixed around locking hook 44 in front of hole 61*a* after the completion of wrapping locking strap 60*a* around finger device 10 and cleaning head 40. Referring to FIGS. 7A–7C, the present invention contemplates that cleaning head 40 may include a second locking hook (not shown) on the opposing end of cleaning head 40. In such a case, holes 61*a* may be affixed around locking hook 44, while hole 61*b* may be affixed around the second locking hook.

Figure 9B:
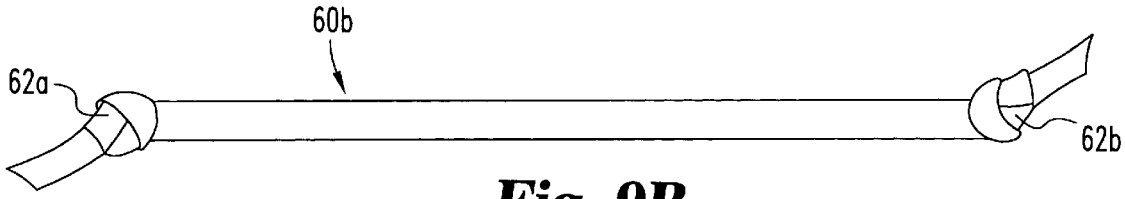
FIG. 9B is a view of a second locking strap in accordance with the second embodiment of the present invention.
Figure 11A:
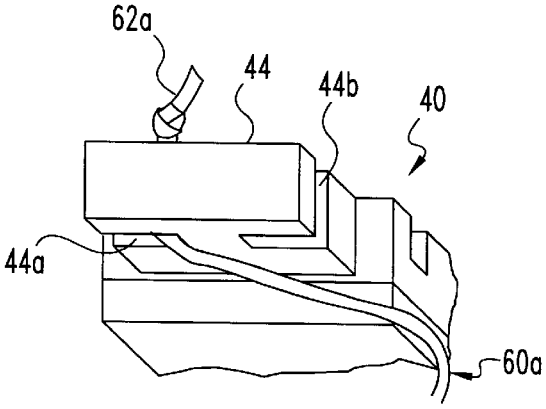
FIG. 11A is a view the second locking strap of FIG. 9B partially connected to the cleaning head of FIGS. 7A–7C.
Figure 11B:
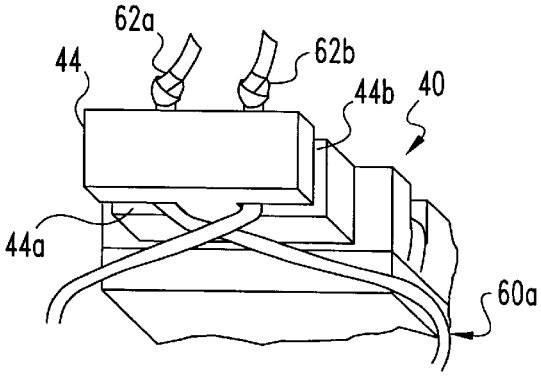
FIG. 11B is a view of the second locking strap of FIG. 9B completely connected to the cleaning head of FIGS. 7A–7C.

FIG. 9B is an illustration of locking strap 60*b*. Locking strap 60*b* includes a first knot 62*a* and a second knot 62*b*. Knots 62*a* and 62*b* are adapted to be secured within either a slit 44*a* of locking hook 44 or a slit 44*b* of locking hook 44. FIG. 11A is illustrative of knots 62*a* secured within slit 44*a* prior to wrapping locking strap 60*b* around finger device 10 and cleaning head 40, while FIG. 11B is illustrative of knot 62*a* secured within slit 44*a* and knot 62*b* secured within slit 44*b* after the completion of wrapping locking strap 60*b* around finger device 10 and cleaning head 40. Referring to FIGS. 7A–7C, the present invention contemplates that cleaning head 40 may include a second locking hook (not shown) on the opposing end of cleaning head 40. In such a case, knot 62*a* may be secured within either slit 44*a* or 44*b* of locking hook 44, while knot 62*b* may be secured within either slit of the second locking hook.

The present invention contemplates that locking straps 60*a* and 60*b* are substantially made from hygienically protective and elastic material such as latex rubber. In addition, it is preferred that locking straps 60*a* and 60*b* be made from material having biodegradable properties. The advantage of biodegradable locking straps 60*a* and 60*b* is the ability to use dental finger toothbrush 2 as a disposal toothbrush without causing significant harm to the environment. It is further preferred that locking straps 60*a* and 60*b* have elastic characteristics similar to a rubber band so as to be significantly stretched if desired.

Figure 12:
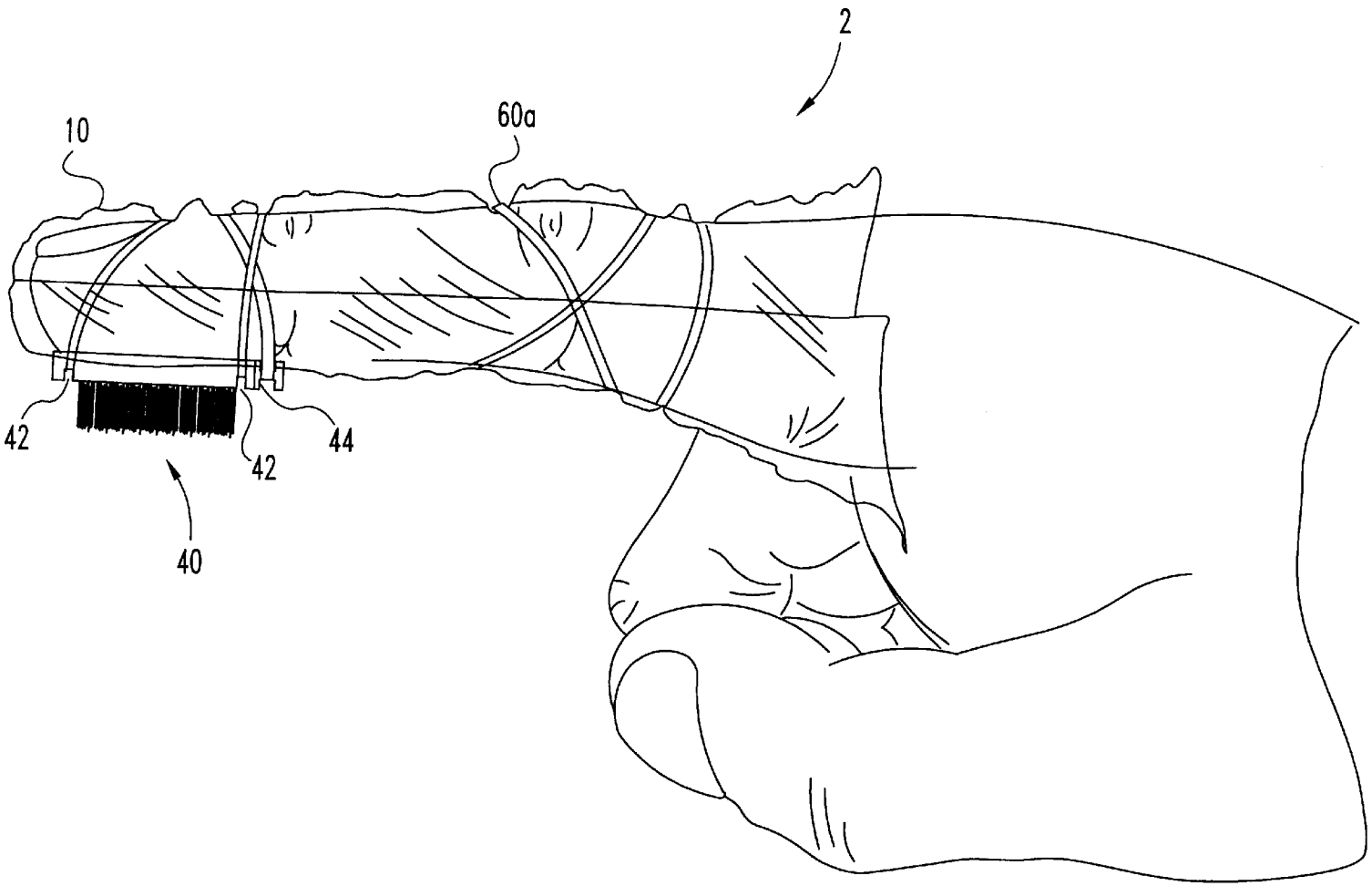
FIG. 12 is a view of a dental finger toothbrush in accordance with the second embodiment of the present invention affixed on a finger.

Locking strap 60*a* and locking strap 60*b* are intended to be wrapped around finger device 10 along most of the length of finger device and coupled to locking hook 44. The present invention contemplates cleaning head 40 can further include grooves 42 so that locking strap 60*a* or locking strap 60*b* can be wrapped within grooves 42 to prevent either locking strap from slipping or moving while being wrapped around finger device 10. FIG. 12 is an illustration of the utilization of locking strap 60*a*. As shown in FIG. 12, locking strap 60*a* is wrapped around finger device 10 and wrapped within grooves 42. In addition, hole 61*a* is affixed around locking hook 44. It is to be appreciated and understood that by wrapping locking straps 60*a* or 60*b* along and around finger device 10 by wrapping locking straps 60*a* or 60*b* within grooves 42, and by securing locking straps 60*a* or 60*b* to cleaning head 40 creates a secure fit around a finger of a user of dental finger toothbrush 2. The advantage of locking straps 60*a* and 60*b* is the ability to manufacture a finger device sufficiently large enough to be received on or rolled onto any finger with the capability of being fitted to every finger. This simplifies the manufacturer of dental finger toothbrush 2.

Referring back to FIG. 6A and 6B, the preferred manufacturing process for dental finger toothbrush 2 is the same manufacturing process herein described for dental finger toothbrush 1. An alternative manufacturing process for dental finger toothbrush 2 will now be described. The first step is to align and couple cleaning head 40 and inside platform 50 with a first layer and a second layer of finger device 10 disposed therebetween. The second step is to seal and cut the first layer and the second layer of finger device 10 in order to form dental finger toothbrush 2 wherein finger device 10 includes a substantial tubular body, and a flap integral with the body and disposed between a coupled cleaning head 40 and inside platform 50.

The present invention contemplates that the flap of finger device 10 is wrapped around the body of finger device 10 when the body of finger device 10 is received on or rolled onto a finger. It is to be appreciated and understood that locking strap 60*a* or locking strap 60*b* is utilized to wrap and secure the flap of finger device 10 around the body of finger device 10 as locking strap 60*a* or locking strap 60*b* is being wrapped around finger device 10 and cleaning head 40 as previously described herein. As with the preferred manufacturing process, the alternative manufacturing process is also simple to implement and cost effective.

Figure 13A:
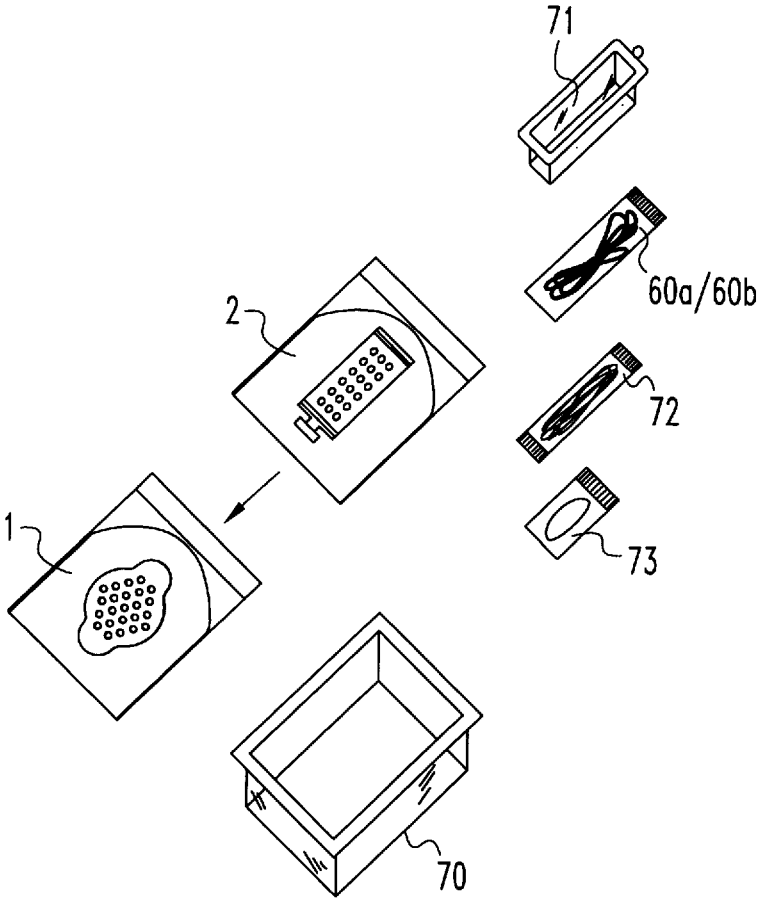
FIG. 13A is a view of a plurality of components for a dental hygiene packet in accordance with the third embodiment of the present invention.
Figure 13B:
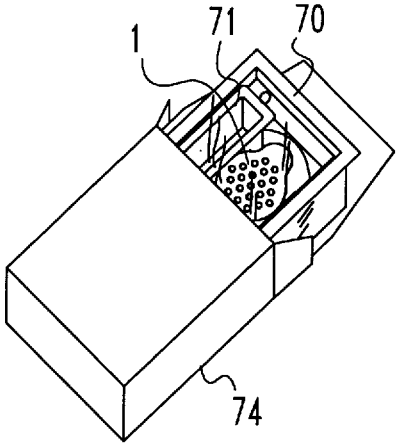
FIG. 13B is a view of a packaged dental hygiene packet of FIG. 13A.

FIG. 13 is an illustration of a dental hygiene packet 70. Dental hygiene packet 70 includes a packaged dental finger toothbrush 1 and/or a packaged dental finger toothbrush 2 with either locking strap 60*a* or locking strap 60*b*. Dental hygiene packet 70 can further include a toothpaste 71, a floss 72, and/or a mint 73. Any combination of these items can be placed within packet 70 and packaged with a box 74. However, toothpaste 71 must be included. The present invention further contemplates that toothpaste 71 can be packaged in a container as shown in FIG. 13*a* or prepackaged within and/or on the cleaning elements of cleaning head 20 and cleaning head 40. FIG. 13B is an illustration of packet 70 with dental finger toothbrush 1, and toothpaste 71 inserted into box 74. It is to be appreciated and understood that FIGS. 13A and 13B are illustrative of only one possible version of packet 70. The present invention contemplates that a packaged dental finger toothbrush 1 and a packaged dental finger toothbrush 2 with either locking strap 60*a* or locking strap 60*b* can be sold individually, in a packet similar to packet 70 or by any means commercially desirable.

While the present invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A dental finger toothbrush comprising:

a substantially tubular finger device having an opened end to receive a finger and an opposed closed end whereby said finger device can be mounted onto the finger by a placement of the finger through said opened end;

a cleaning head; and an inside platform coupled to said cleaning head with a portion of said finger device disposed between said coupling.

2. The dental finger toothbrush of claim 1 wherein said cleaning head includes a groove bonded to said finger device, and wherein said inside platform includes a prong bonded to said finger device and mated with said groove.

3. The dental finger toothbrush of claim 1 wherein said cleaning head includes a slot, and wherein said inside platform includes a prong coupled with said slot.

4. The dental finger toothbrush of claim 3 wherein said prong is snapped within said slot.

5. The dental finger toothbrush of claim 3 wherein said prong is tension fitted within said slot.

6. The dental finger toothbrush of claim 1 further comprising a locking strap adapted to be attached to said cleaning head.

7. The dental finger toothbrush of claim 6 wherein said cleaning head includes a locking hook and wherein said locking strap includes a first hole and a second hole, said holes adapted to be affixed around said locking hook.

8. The dental finger toothbrush of claim 6 wherein said cleaning head includes a locking hook and wherein said locking strap includes a first knot and a second knot, said knots adapted to be secured to said locking hook.

9. The dental finger toothbrush of claim 6 wherein said cleaning head further includes a groove, and where said locking strap is adapted to be receivable within said groove.

10. The dental finger toothbrush of claim 1 wherein said inside platform includes at least one gripping hole.

11. A dental finger toothbrush comprising:

a finger device having a first end and a second end;

a cleaning head including a locking hook;

an inside platform coupled to said cleaning head, wherein said first end of said finger device is disposed between said coupling; and a locking strap including a first hole and a second hole, said holes adapted to be affixed around said locking hook.

12. The dental finger toothbrush of claim 11 wherein said cleaning head further includes a groove bonded to said finger device, and wherein said inside platform includes a prong bonded to said finger device and mated with said groove.

13. The dental finger toothbrush of claim 11 wherein said cleaning head further includes a slot, and wherein said inside platform includes a prong coupled with said slot.

14. The dental finger toothbrush of claim 13 wherein said prong is snapped within said slot.

15. The dental finger toothbrush of claim 13 wherein said prong is tension fitted within said slot.

16. A dental finger toothbrush comprising:

a finger device having a first end and a second end;

a cleaning head including a locking hook;

an inside platform coupled to said cleaning head, wherein said first end of said finger device is disposed between said coupling; and a locking strap including a first knot and a second knot, said knots adapted to be secured to said locking hook.

17. The dental finger toothbrush of claim 16 wherein said cleaning head further includes a groove bonded to said finger device, and wherein said inside platform includes a prong bonded to said finger device and mated with said groove.

18. The dental finger toothbrush of claim 16 wherein said cleaning head further includes a slot, and wherein said inside platform includes a prong coupled with said slot.

19. The dental finger toothbrush of claim 18 wherein said prong is snapped within said slot.

20. The dental finger toothbrush of claim 18 wherein said prong is tension fitted within said slot.

* * * * *